US006420326B1

(12) United States Patent
Maile et al.

(10) Patent No.: US 6,420,326 B1
(45) Date of Patent: Jul. 16, 2002

(54) GLASS CLEANER COMPOSITIONS HAVING GOOD SURFACE LUBRICITY AND ALKALINE BUFFER

(75) Inventors: Michael Stephen Maile, Maineville; Alan Edward Sherry, Cincinnati, both of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/485,587

(22) PCT Filed: Aug. 6, 1998

(86) PCT No.: PCT/IB98/01209

§ 371 (c)(1),
(2), (4) Date: Feb. 11, 2000

(87) PCT Pub. No.: WO99/09135

PCT Pub. Date: Feb. 25, 1999

Related U.S. Application Data

(60) Provisional application No. 60/055,279, filed on Aug. 13, 1997.

(51) Int. Cl.[7] ..... C11D 9/04; C11D 65/06

(52) U.S. Cl. ..... 510/181; 510/180; 510/163; 510/179

(58) Field of Search ..... 510/180, 181, 510/163, 179

(56) References Cited

U.S. PATENT DOCUMENTS 6,194,362 B1 * 2/2001 Trinh et al. ..... 510/101
6,281,178 B1 * 8/2001 Ryklin et al. ..... 510/181

FOREIGN PATENT DOCUMENTS

WO WO 96/34933 11/1996 ..... C11D/1/14

* cited by examiner

*Primary Examiner*—Yogendra N. Gupta
*Assistant Examiner*—John M Petruncio
(74) *Attorney, Agent, or Firm*—Kevin L. Waugh; Jason C. Camp

(57) ABSTRACT

The present invention relates to an aqueous, liquid hard surface detergent composition having excellent surface lubricity and filming/streaking characteristics. Said composition comprises less than about 1%, by weight of the composition, of surfactant to provide lubricity, preferably straight chain alkyl sulfate wherein at least about 30%, preferably wherein more than about 50%, of said surfactant, by weight, has a $C_{12}$ or $C_{14}$ chain length or mixtures thereof; hydrophobic cleaning solvent; an optional substantive material that increases the hydrophilicity of the glass; and preferred low level of alkaline buffering agent to provide composition stability on storage and alkalinity, without diminishing the lubricity.

28 Claims, No Drawings

GLASS CLEANER COMPOSITIONS HAVING GOOD SURFACE LUBRICITY AND ALKALINE BUFFER

This appln is a 371 of PCT/IB98/01209 filed Aug. 6, 1998, which claims benefit of Prov. No. 60/055,279 filed Aug. 13, 1997.

FIELD OF INVENTION

This invention pertains to glass cleaning compositions, preferably clear liquid detergent compositions, for use in cleaning glass and hard surfaces and, preferably, other hard surfaces.

BACKGROUND OF THE INVENTION

There is a strong consumer preference for liquid cleaning compositions, especially compositions prepared for cleaning glass, that impart a smooth "gliding" feel, based on good surface lubricity, as the cleaning implement wipes and dries.

Because good filming/streaking properties are required especially for glass cleaners, the levels of surfactants and other actives must be kept low in order to achieve this benefit. It is highly desirable that the compositions be alkaline and have sufficient buffering capacity to provide cleaning and stability.

Also, it is known in the art that water-sheeting and anti-spotting benefits are preferred in glass cleaning compositions. These water-sheeting and anti-spotting benefits are typically achieved by providing a composition which leaves behind a hydrophilic residue.

Long chain, e.g., $C_{12}$–$C_{14}$ or longer, alkyl sulfate detergent surfactants provide the desired amount of surface lubricity as the composition is wiped dry on glass as well as contributing detergency and providing acceptable filming/streaking results and product clarity. Furthermore, the long-chain alkyl sulfate surfactants are soluble in water and help to reinforce the surface hydrophilicity that is required in order to obtain water-sheeting and anti-spotting benefits.

SUMMARY OF THE INVENTION

The present invention relates to detergent compositions, preferably glass and surface cleaning compositions, that impart good surface lubricity and cleaning without leaving objectionable levels of filming and/or streaking. Preferably, said compositions contain an effective amount of substantive material which provides the glass with long lasting higher hydrophilicity and are in the form of an aqueous, liquid, hard surface detergent composition having improved cleaning and good spotting characteristics after rewetting, comprising:

(A) less than about 1%, by weight of the composition, of surfactant to provide lubricity, preferably a linear alkyl sulfate detergent surfactant having the general formula:

$$R—O—SO_3M$$

wherein M is a suitable counter ion; R is an alkyl group having a chain length of from about $C_8$ to about $C_{18}$ or mixtures thereof; preferably wherein more than about 30%, of said surfactant, by weight, has a $C_{12}$ or $C_{14}$ chain length;

(B) from about 0.5% to about 30%, by weight of the composition, of a hydrophobic solvent having a hydrogen bonding parameter of from about 2 to 7.7;

(C) a low critical amount of alkaline buffering agent, preferably an alkanolamine, more preferably a beta-aminoalkanol, and most preferably, 2-amino-2-methyl-1-propanol to maintain the pH at from about 8.0 to about 11.0, preferably from about 8.5 to about 10.5, more preferably from about 9.0 to about 10.5, to provide buffering capacity equivalent to from about 0.010% to about 0.050%, preferably from about 0.015% to about 0.045%, more preferably from about 0.020% to about 0.040%, of 2-amino-2-methyl-1-propanol; and (D) an optional but preferred, substantive material that increases the hydrophilicity of the glass; and (E) the balance being an aqueous solvent system selected from the group consisting of water and non-aqueous polar solvents having a hydrogen bonding parameter of greater than 7.7; and wherein said composition is essentially free of ingredients that cause spotting/filming.

DETAILED DESCRIPTION OF THE INVENTION

The present invention relates to detergent compositions, preferably aqueous, liquid hard surface detergent compositions having excellent surface lubricity and filming/streaking characteristics, comprising:

(A) less than about 1%, by weight of the composition, of surfactant to provide lubricity, preferably a linear alkyl sulfate detergent surfactant having the general formula:

$$R—O—SO_3M$$

wherein M is a suitable counter ion; R is an alkyl group having a chain length of from about $C_8$ to about $C_{18}$ or mixtures thereof, preferably wherein more than about 30%, of said surfactant, by weight, has a $C_{12}$ or $C_{14}$ chain length;

(B) from about 0.5% to about 30%, by weight of the composition, of a hydrophobic solvent having a hydrogen bonding parameter of from about 2 to 7.7;

(C) a low critical amount of alkaline buffering agent, preferably an alkanolamine, more preferably a beta-aminoalkanol, and most preferably, 2 amino-2-methyl-1-propanol to maintain the pH at from about 8.0 to about 11.0, preferably from about 8.5 to about 10.5, more preferably from about 9.0 to about 10.5, to provide buffering capacity equivalent to from about 0.010% to about 0.050%, preferably from about 0.015% to about 0.045%, more preferably from about 0.020% to about 0.040%, of 2-amino-2-methyl-1-propanol; and (D) an optional but preferred, substantive material that increases the hydrophilicity of the glass; and (E) the balance being an aqueous solvent system selected from the group consisting of water and non-aqueous polar solvents having a hydrogen bonding parameter of greater than 7.7; and wherein said composition is essentially free of ingredients that cause spotting/filming.

(A) The Surfactant

The aqueous, liquid hard surface detergent compositions herein contain less than about 1%, by weight of the composition, preferably from about 0.01% to about 1%, more preferably from about 0.02% to about 0.3%, by weight of the composition, of one or more surfactants that provide lubricity to the surface of the glass. Preferably, the surfactant comprises linear alcohol sulfate detergent surfactant having the general formula:

$$R—O—SO_3M$$

wherein M is any suitable counterion, preferably sodium, potassium, etc.; and wherein R is an alkyl group with a chain length of from about $C_8$ to about $C_{18}$ and mixtures thereof, preferably from about $C_{10}$ to about $C_{18}$ and mixtures thereof, more preferably from about $C_{12}$ to about $C_{18}$ and mixtures thereof, and preferably wherein R is $C_{12}$ or $C_{14}$ in at least about 30%, preferably more than about 40%, more preferably more than about 50%, and most preferably more than about 60%, by weight of the alkyl sulfate. The entire alkyl sulfate surfactant can contain R of longer chain length(s), but more than 30%, by weight of the alkyl surfactant is preferably a $C_{12}$ or $C_{14}$ chain length. Compositions containing only alkyl sulfate surfactants with higher chain lengths, i.e., $C_{16-18}$ provide good surface lubricity benefits. However, these chain lengths, tend to exhibit poorer filming/streaking properties when used alone. On the other hand, compositions which are solely made up of lower-chain alkyl sulfate surfactants, i.e., $C_{8-10}$ alkyl sulfate surfactants, provide acceptable filming/streaking properties but tend to exhibit poorer surface lubricity properties. The presence of the $C_{12}$ or $C_{14}$ chain length at levels of more than about 15%, by weight of the alkyl sulfate surfactant, in combination with other chain lengths, or alone, can provide a product with both excellent surface lubricity properties and excellent filming/streaking properties. Particularly preferred compositions contain from about 0.05% to about 0.35%, by weight of the composition, of a $C_{12/14}$ blend in which the $C_{12}$ to $C_{14}$ weight ratio is from about 1.5:10 to about 2:1, preferably from about 1:5 to about 1.5:1, and more preferably from about 1:3 to about 1:1. This combination has been found to provide sufficient surface lubricity while avoiding objectionable filming/streaking. The alcohol sulfate detergent raw materials selected are essentially free from unreacted fatty alcohol wherein the term "essentially free" is defined as having less than about 2%, by weight of the composition, preferably less than about 1.8%, and more preferably less than about 1.5%, by weight of the composition of unreacted fatty alcohol in a nominally 30% active raw material. It is a special advantage of this invention that it improves the lubricity of most surfactants, including the optional surfactants described hereinafter, and especially of shorter chain alkyl sulfate surfactants.

Concentrated compositions can also be used in order to provide a less expensive product. When a higher concentration is used, i.e., when the level of alkyl sulfate surfactant used is from about 0.10% to about 2.5%, by weight of the composition, it is preferable to dilute the composition before using it to clean a hard surface, especially glass. Dilution ratios of the alkyl sulfate concentrate(s) to water can range, preferably, from about 1:1 to 1:10, more preferably from about 1:1.5 to 1:5, and most preferably from about 1:2 to 1:5.

The Optional Co-Surfactants

The aqueous, liquid hard surface detergent compositions of the present invention can contain optional co-surfactants. Suitable co-surfactants which can be used are as follows:

(1) The Amphocarboxylate Detergent Surfactant

The aqueous, liquid hard surface detergent compositions (cleaners) herein can contain from 0% to about 0.5%, by weight of the composition, preferably from about 0.01% to about 0.5%, more preferably from about 0.02% to about 0.2%, and even more preferably from about 0.03% to about 0.08%, by weight of the composition, of $C_{6-10}$ short chain amphocarboxylate detergent surfactant. It has been found that these amphocarboxylate, and, especially glycinate, detergent surfactants provide good cleaning with superior filming/streaking for detergent compositions that are used to clean both glass and/or relatively hard-to-remove soils. Despite the short chain, the detergency is good and the short chains provide improved filming/streaking, even as compared to most of the zwitterionic detergent surfactants described hereinafter. Depending upon the level of cleaning desired and/or the amount of hydrophobic material in the composition that needs to be solubilized, one can either use only the amphocarboxylate detergent surfactant, or can combine it with cosurfactant, preferably said zwitterionic surfactants.

The "amphocarboxylate" detergent surfactants herein preferably have the generic formula:

$$R'N(R^1)(CH_2)_nN(R^2)(CH_2)_pC(O)OM$$

wherein R' is a $C_{6-10}$ hydrophobic moiety, typically a fatty acyl moiety containing from about 6 to about 10 carbon atoms which, in combination with the nitrogen atom forms an amido group, $R^1$ is hydrogen (preferably) or a $C_{1-2}$ alkyl group, $R^2$ is a $C_{1-3}$ alkyl or, substituted $C_{1-3}$ alkyl, e.g., hydroxy substituted or carboxy methoxy substituted, preferably, hydroxy ethyl, each n is an integer from 1 to 3, each p is an integer from 1 to 2, preferably 1, and each M is a water-soluble cation, typically an alkali metal, ammonium, and/or alkanolammonium cation. Such detergent surfactants are available, for example: from Witco under the trade name Rewoteric AM-V®, having the formula $$C_7H_{15}C(O)NH(CH_2)_2N(CH_2CH_2OH)CH_2C(O)O^{(-)}Na^{(+)};$$

Mona Industries, under the trade name Monateric 1000®, having the formula $$C_7H_{15}C(O)NH(CH_2)_2N(CH_2CH_2OH)CH_2CH_2C(O)O^{(-)}Na^{(+)};$$

and Lonza under the trade name Amphoterge KJ-2®, having the formula $$C_{7,9}H_{15,19}C(O)NH(CH_2)_2N(CH_2CH_2OCH_2C(O)O^{(-)}Na^{(+)})CH_2C(O)O^{(-)}Na^{(+)}$$

(2) Zwitterionic Detergent Surfactant

The aqueous, liquid hard surface detergent compositions (cleaners) herein can contain from about 0% to about 1%, by weight of the composition, of suitable zwitterionic detergent surfactant containing a cationic group, preferably a quaternary ammonium group, and an anionic group, preferably carboxylate, sulfate and/or sulfonate group, more preferably sulfonate. A more preferred range of zwitterionic detergent surfactant inclusion is from about 0.005% to about 0.3% of surfactant, a most preferred range is from about 0.01% to about 0.2%, by weight of the composition.

Zwitterionic detergent surfactants, as mentioned hereinbefore, contain both a cationic group and an anionic group and are in substantial electrical neutrality where the number of anionic charges and cationic charges on the detergent surfactant molecule are substantially the same. Zwitterionic detergents, which typically contain both a quaternary ammonium group and an anionic group selected from sulfonate and carboxylate groups are desirable since they maintain their amphoteric character over most of the pH range of interest for cleaning hard surfaces. The sulfonate group is the preferred anionic group.

Preferred zwitterionic detergent surfactants have the generic formula:

$$R^3—[C(O)—N(R^4)—(CR^5{}_2)n^1]_mN(R^6)_2{}^{(+)}—(CR^5{}_2)_p1—Y^{(-)}$$

wherein each Y is preferably a carboxylate ($COO^-$) or sulfonate ($SO_3^-$) group, more preferably sulfonate; wherein each $R^3$ is a hydrocarbon, e.g., an alkyl, or alkylene, group containing from about 8 to about 20, preferably from about 10 to about 18, more preferably from about 12 to about 16 carbon atoms; wherein each ($R^4$) is either hydrogen, or a short chain alkyl, or substituted alkyl, containing from one to about four carbon atoms, preferably groups selected from the group consisting of methyl, ethyl, propyl, hydroxy substituted ethyl or propyl and mixtures thereof, preferably methyl; wherein each ($R^5$) is selected from the group consisting of hydrogen and hydroxy groups with no more than one hydroxy group in any $(CR^5{}_2)p^1$ group; wherein ($R^6$) is like $R^4$ except preferably not hydrogen; wherein m is 0 or 1; and wherein each $n^1$ and $p^1$ are an integer from 1 to about 4, preferably from 2 to about 3, more preferably about 3. The $R^3$ groups can be branched, unsaturated, or both and such structures can provide filming/streaking benefits, even when used as part of a mixture with straight chain alkyl $R^3$ groups. The $R^4$ groups can also be connected to form ring structures such as imidazoline, pyridine, etc. Preferred hydrocarbyl amidoalkylene sulfobetaine (HASB) detergent surfactants wherein m=1 and Y is a sulfonate group provide superior grease soil removal and/or filming/streaking and/or "anti-fogging" and/or perfume solubilization properties. Such hydrocarbylamidoalkylene sulfobetaines, and, to a lesser extent hydrocarbylamidoalkylene betaines are excellent for use in hard surface cleaning detergent compositions, especially those formulated for use on both glass and hard-to-remove soils. They are even better when used with 2-methyl-2-amino-1-propanol, monoethanolamine and/or specific beta-amino alkanol as disclosed herein.

A more preferred specific detergent surfactant is a $C_{10-14}$ fatty acylamidopropylene(hydroxypropylene)sulfobetaine, e.g., the detergent surfactant available from the Witco Company as a 40% active product under the trade name "REWOTERIC AM CAS Sulfobetaine®."

The level in the composition is dependent on the eventual level of dilution to make the wash solution. For glass cleaning, the composition, when used full strength, or wash solution containing the composition, should contain from about 0.0% to about 1%, preferably from about 0.005% to about 0.5%, more preferably from about 0.01% to about 0.25%, by weight of the composition, of detergent surfactant. For removal of difficult to remove soils like grease, the level can, and should be, higher, typically from about 0% to about 10%, preferably from about 0.005% to about 2%, by weight of the composition. Concentrated products will typically contain from about 0% to about 10%, preferably from about 0.005% to about 5%, by weight of the composition. It is an advantage of the zwitterionic detergent, e.g., HASB, that compositions containing it can be more readily diluted by consumers since it does not interact with hardness cations as readily as conventional anionic detergent surfactants. Zwitterionic detergents are also extremely effective at very low levels, e.g., below about 1%.

Other zwitterionic detergent surfactants are set forth at Col. 4 of U.S. Pat. No. 4,287,080, Siklosi, incorporated herein by reference. Another detailed listing of suitable zwitterionic detergent surfactants for the detergent compositions herein can be found in U.S. Pat. No. 4,557,853, Collins, issued Dec. 10, 1985, incorporated by reference herein. Commercial sources of such surfactants can be found in McCutcheon's EMULSIFIERS AND DETERGENTS, North American Edition, 1997, McCutcheon Division, MC Publishing Company, also incorporated herein by reference.

(3) The Optional Anionic Detergent Surfactants

The detergent compositions, preferably aqueous, liquid hard surface detergent compositions, herein can contain as the cosurfactant, preferably, from about 0.0% to about 2.0%, more preferably from about 0.005% to about 0.99% of suitable anionic detergent surfactant other than the essential alkyl sulfate detergent surfactant. While it is understood that the longer chain alkyl sulfate surfactants disclosed herein are considered the primary surfactant system, additional co-surfactants can be added including alkyl sulfate surfactants of even lower chain lengths. The optional anionic surfactants are suitably water-soluble alkyl or alkylaryl compounds, the alkyl having from about 6 to about 20 carbons, and including a sulfate or sulfonate substituent group, but excluding the essential alkyl sulfate detergent surfactant. Depending upon the level of cleaning desired one can use only the essential anionic detergent surfactant, or, more preferably, the anionic detergent surfactant can be combined with a cosurfactant, preferably an amphoteric cosurfactant. Nonionic surfactants, e.g., ethoxylated alcohols and/or alkyl phenols, can also be used as cosurfactants but are not preferred.

The anionic detergent surfactants herein preferably have the generic formula:

$$R^9—(R^{10})_{0-1}—SO_3{}^{(-)}M^{(+)}$$

wherein $R^9$ is a $C_6$-$C_{20}$ alkyl chain, preferably a $C_8$-$C_{16}$ alkyl chain; $R^{10}$, when present, is a $C_6$-$C_{20}$ alkylene chain, preferably a $C_8$-$C_{16}$ alkylene chain, a $C_6$H4 phenylene group, or O; and M is the same as before.

The patents and references disclosed hereinbefore and incorporated by reference also disclose other detergent surfactants, e.g., anionic, and, less preferably, nonionic detergent surfactants, that can be used in small amounts, preferably as cosurfactants for the essential alkyl sulfate detergent surfactant and preferred amphoteric/zwitterionic detergent cosurfactant. The cosurfactant level can be small in relation to the primary surfactant. Typical of these are the alkyl- and alkylethoxylate- (polyethoxylate) sulfates, paraffin sulfonates, olefin sulfonates, alkoxylated (especially ethoxylated) alcohols and alkyl phenols, alkyl phenol sulfonates, alpha-sulfonates of fatty acids and of fatty acid esters, and the like, which are well-known from the detergency art. When the pH is above about 9.5, detergent surfactants that are amphoteric at a lower pH are desirable anionic detergent cosurfactants. For example, detergent surfactants which are $C_{12}$–$C_{18}$ acylamido alkylene amino alkylene sulfonates, e.g., compounds having the formula R—C(O)—NH—($C_2H_4$)—N($C_2H_4OH$)—$CH_2CH(OH)CH_2SO_3M$ wherein R is an alkyl group containing from about 9 to about 18 carbon atoms and M is a compatible cation are desirable cosurfactants. These detergent surfactants are available as Miranol® CS, OS, JS, etc. The CTFA adopted name for such surfactants is cocoamphohydroxypropyl sulfonate. It is preferred that the compositions be substantially free of alkyl naphthalene sulfonates.

In general, detergent surfactants useful herein contain a hydrophobic group, typically containing an alkyl group in the $C_9$–$C_{18}$ range, and, optionally, one or more linking groups such as ether or amido, preferably amido, groups. The anionic detergent surfactants can be used in the form of their sodium, potassium, or alkanolammonium, e.g., triethanolammonium salts; the nonionics, not preferred, generally contain from about 5 to about 17 ethylene oxide groups.

Some suitable surfactants for use herein in small amounts are one or more of the following: sodium linear $C_8$–$C_{18}$ alkyl benzene sulfonate (LAS), particularly $C_{11}$–$C_{12}$ LAS; the sodium salt of a coconut alkyl ether sulfate containing 3 moles of ethylene oxide; the adduct of a random secondary alcohol having a range of alkyl chain lengths of from 11 to 15 carbon atoms and an average of 2 to 10 ethylene oxide moieties, several commercially available examples of which are Tergitol® 15-S-3, Tergitol® 15-S-5, Tergitol® 15-S-7, and Tergitol® 15-S-9, all available from Union Carbide Corporation; the sodium and potassium salts of coconut fatty acids (coconut soaps); the condensation product of a straight-chain primary alcohol containing from about 8 carbons to about 16 carbon atoms and having an average carbon chain length of from about 10 to about 12 carbon atoms with from about 4 to about 8 moles of ethylene oxide per mole of alcohol; an amide having one of the preferred formulas:

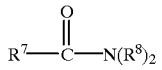

wherein $R^7$ is a straight-chain alkyl group containing from about 7 to about 15 carbon atoms and having an average carbon chain length of from about 9 to about 13 carbon atoms and wherein each $R^8$ is a hydroxy alkyl group containing from 1 to about 3 carbon atoms; a zwitterionic surfactant having one of the preferred formulas set forth hereinafter; or a phosphine oxide surfactant. Another suitable class of surfactants is the fluorocarbon surfactants, examples of which are FC-129®, a potassium fluorinated alkylcarboxylate and FC-170-C®, a mixture of fluorinated alkyl polyoxyethylene ethanols, both available from 3M Corporation, as well as the Zonyl® fluorosurfactants, available from DuPont Corporation. It is understood that mixtures of various surfactants can be used.

(4) Mixtures

Mixtures of amphocarboxylate, zwitterionic detergent surfactants, and/or anionic detergent surfactants as discussed hereinbefore, can be present in the present invention.

When a co-surfactant is added to the composition of the present invention, the total surfactant level can be from about 0.01% to about 5%, by weight of the total composition however, the alkyl surfactant should be present at a level less than 1%, by weight of the composition. The ratio of zwitterionic detergent surfactant to amphocarboxylate detergent surfactant is typically from about 3:1 to about 1:3, preferably from about 2:1 to about 1:2, more preferably about 1:1. The ratio of the primary $C_{14}$ alkyl sulfate detergent surfactant to cosurfactant, or cosurfactants, is typically from about 3:1 to about 1:1.

(B) Hydrophobic Solvent

In order to improve cleaning in liquid compositions, one can use a hydrophobic solvent that has cleaning activity. The solvents employed in the hard surface cleaning compositions herein can be any of the well-known "degreasing" solvents commonly used in, for example, the dry cleaning industry, in the hard surface cleaner industry and the metalworking industry.

A useful definition of such solvents can be derived from the solubility parameters as set forth in "The Hoy," a publication of Union Carbide, incorporated herein by reference. The most useful parameter appears to be the hydrogen bonding parameter which is calculated by the formula:

$$\gamma H = \gamma T\left[\frac{a-1}{a}\right]^{1/2}$$

wherein γH is the hydrogen bonding parameter, a is the aggregation number, $$\left(\text{Log } \alpha = 3.39066\, T_b / T_c - 0.15848 - \text{Log}\frac{M}{d}\right),$$

γT is the solubility parameter which is obtained from the formula:

$$\gamma T = \left[\frac{(\Delta H_{25} - RT)d}{M}\right]^{1/2}$$

where $\Delta H_{25}$ is the heat of vaporization at 25° C., R is the gas constant (1.987 cal/mole/deg), T is the absolute temperature in °K, $T_b$ is the boiling point in °K, $T_c$ is the critical temperature in °K, d is the density in g/ml, and M is the molecular weight.

For the compositions herein, hydrogen bonding parameters are preferably less than about 7.7, more preferably from about 2 to about 7, and even more preferably from about 3 to about 6. Solvents with lower numbers become increasingly difficult to solubilize in the compositions and have a greater tendency to cause a haze on glass. Higher numbers require more solvent to provide good greasy/oily soil cleaning.

Hydrophobic solvents are typically used at a level of from about 0.5% to about 30%, preferably from about 1% to about 15%, more preferably from about 1.5% to about 8%. Dilute compositions typically have solvents at a level of from about 1% to about 10%, preferably from about 3% to about 6%. Concentrated compositions contain from about 10% to about 30%, preferably from about 10% to about 20% of solvent.

Many of such solvents comprise hydrocarbon or halogenated hydrocarbon moieties of the alkyl or cycloalkyl type, and have a boiling point well above room temperature, i.e., above about 20° C.

The formulator of compositions of the present type will be guided in the selection of cosolvent partly by the need to provide good grease-cutting properties, and partly by aesthetic considerations. For example, kerosene hydrocarbons function quite well for grease cutting in the present compositions, but can be malodorous. Kerosene must be exceptionally clean before it can be used, even in commercial situations. For home use, where malodors would not be tolerated, the formulator would be more likely to select solvents which have a relatively pleasant odor, or odors which can be reasonably modified by perfuming.

The $C_6$–$C_9$ alkyl aromatic solvents, especially the $C_6$–$C_9$ alkyl benzenes, preferably octyl benzene, exhibit excellent grease removal properties and have a low, pleasant odor. Likewise, the olefin solvents having a boiling point of at least about 100° C., especially alpha-olefins, preferably 1-decene or 1-dodecene, are excellent grease removal solvents.

Generically, the glycol ethers useful herein have the formula $R^{11}$ O—($R^{12}$O—)$_m$1H wherein each $R^{11}$ is an alkyl group which contains from about 3 to about 8 carbon atoms, each $R^{12}$ is either ethylene or propylene, and $m^1$ is a number from 1 to about 3. The most preferred glycol ethers are selected from the group consisting of monopropyleneglycolmonopropyl ether, dipropyleneglycolmonobutyl ether, monopropyleneglycolmonobutyl ether, ethyleneglycolmonohexyl ether, ethyleneglycolmonobutyl ether, diethyleneglycolmonohexyl ether, monoethyleneglycolmonohexyl ether, monoethyleneglycolmonobutyl ether, and mixtures thereof.

A particularly preferred type of solvent for these hard surface cleaner compositions comprises diols having from 6 to about 16 carbon atoms in their molecular structure. Preferred diol solvents have a solubility in water of from about 0.1 to about 20 g/100 g of water at 20° C.

Solvents such as pine oil, orange terpene, benzyl alcohol, n-hexanol, phthalic acid esters of $C_{1-4}$ alcohols, butoxy propanol, Butyl Carbitol® and 1(2-n-butoxy-1-methylethoxy)propane-2-ol (also called butoxy propoxy propanol or dipropylene glycol monobutyl ether), hexyl diglycol (Hexyl Carbitol®), butyl triglycol, diols such as 2,2,4-trimethyl-1,3-pentanediol, and mixtures thereof, can be used. The butoxy-propanol solvent preferably has no more than about 20%, preferably no more than about 10%, more preferably no more than about 7%, of the secondary isomer in which the butoxy group is attached to the secondary atom of the propanol for improved odor.

(C) The Alkalinity Source

The compositions of this invention contain an alkalinity source at a low critical level. The alkaline buffering agent is preferably an alkanolamine, more preferably a beta-aminoalkanol, and most preferably, 2-amino-2-methyl-1-propanol (AMP). The level is sufficient to maintain the pH at from about 8.5 to about 11.0, preferably from about 8.5 to about 10.5, more preferably from about 9.0 to about 10.5, and to provide buffering capacity equivalent to from about 0.010% to about 0.050%, preferably from about 0.015% to about 0.045%, more preferably from about 0.020% to about 0.040%, of 2-amino-2-methyl-1-propanol. Lower levels are not sufficient to maintain long term stability and higher levels start to harm the desirable lubricity of the compositions.

Alkanolamine compounds as an alkalinity source in the present invention, can interfere with the surface lubricity benefit achieved by, e.g., the long-chain alkyl sulfate surfactants. It is therefore essential to control the level of the alkanolamine.

Preferred alkanolamines are beta-aminoalkanol compounds. They serve primarily as solvents when the pH is above about 8.5, and especially above about 9.0. They also can provide alkaline buffering capacity during use. Preferred beta-aminoalkanols have a primary hydroxy group. Suitable beta-aminoalkanols have the formula:

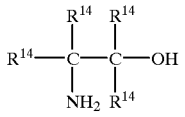

wherein each $R^{14}$ is selected from the group consisting of hydrogen and alkyl groups containing from one to four carbon atoms and the total of carbon atoms in the compound is from three to six, preferably four. Examples of suitable preferred beta-aminoalkanols include monoethanol amine, diethanolamine, triethanolamine and the like. More preferably the amine group is attached to a secondary or tertiary carbon atom to minimize the reactivity of the amine group. Specific more preferred beta-aminoalkanols are 2-amino-1-butanol; 2-amino-2-methyl-1-propanol; and mixtures thereof. The most preferred beta-aminoalkanol is 2-amino-2-methyl-1-propanol since it has the lowest molecular weight of any beta-aminoalkanol which has the amine group attached to a tertiary carbon atom. The beta-aminoalkanols preferably have boiling points below about 175° C. Preferably, the boiling point is within about 5° C. of 165° C.

Beta-aminoalkanols, and especially monoethanolamine and the preferred 2-amino-2-methyl-1-propanol, are surprisingly volatile from cleaned surfaces considering their relatively high molecular weights. It is found that levels below an equivalent of about 0.010% 2-amino-2-methyl-1-propanol are insufficient to provide the necessary buffering capacity necessary to maintain the pH of the formulations within a narrow range. Conversely, levels above an equivalent of 0.050% 2-amino-2-methyl-1-propanol are deleterious to the lubricity properties of formulations and can adversely affect filming/streaking performance.

The low but critical level of buffer, preferably alkanolamine, more preferably monoethanolamine, most preferably 2-amino-2-methyl-1-propanol, provides the glass and/or surface cleaner formulations with improved lubricity capacity. While it is known that at high buffer levels, $C_{14}$ chainlength is needed for lubricity (U.S. patent application Ser. No. 08/762,033, filed Dec. 9, 1996, Masters et al.), said application being incorporated herein by reference, formulations of the present invention can deliver the desired lubricity without the need for C14 chain length alkyl sulfate surfactants. The ability to formulate a glass and/or multi-surface cleaner product with $C_{12}$ and lower chain length alkyl sulfate surfactants, allows for improved grease and dirt cleaning efficiency without sacrificing the important glide/surface lubricity characteristics.

Other suitable alkalinity agents that can also be used, but less desirably, include alkali metal hydroxides, i.e., sodium, potassium, etc., and carbonates or sodium bicarbonates. Water-soluble alkali metal carbonate and/or bicarbonate salts, such as sodium bicarbonate, potassium bicarbonate, potassium carbonate, cesium carbonate, sodium carbonate, and mixtures thereof, can added to the composition of the present invention in order to improve the filming/streaking when the product is wiped dry on the surface, as is typically done in glass cleaning. Preferred salts are sodium carbonate, potassium carbonate, sodium bicarbonate, potassium bicarbonate, their respective hydrates, and mixtures thereof. Solubilized, water-soluble alkali metal carbonate and bicarbonate salts are typically present at a level of from about 0% to about 0.5%, preferably from about 0.001% to about 0.1%, more preferably from about 0.005% to about 0.05%, by weight of the composition. The pH in the composition, at least initially, in use is from about 7 to about 11, preferably from about 7.5 to about 10.5, more preferably from about 8 to about 10. pH is typically measured on the product.

(D) Optional, but Preferred, Substantive Material that Increases Hydrophilicity of Glass An optional but preferred ingredient of this invention is the substantive material that improves the hydrophilicity of the surface being treated, especially glass. This increase in hydrophilicity provides improved appearance when the surface is rewetted and then dried. The water "sheets" off the surface and thereby minimizes the formation of, e.g., "rainspots" that form upon drying. Many materials can provide this benefit, but the preferred materials are polymers that contain hydrophilic groups, especially carboxylate or sulfonate groups. Other materials that can provide substantivity and hydrophilicity include cationic materials that also contain hydrophilic groups and polymers that contain multiple ether linkages. Cationic materials include cationic sugar and/or starch derivatives and the typical block copolymer detergent surfactants based on mixtures of polypropylene oxide and ethylene oxide are representative of the polyether materials. The polyether materials are less substantive, however.

The preferred polycarboxylate polymers are those formed by polymerization of monomers, at least some of which contain carboxylic functionality. Common monomers include acrylic acid, maleic acid, ethylene, vinyl pyrrolidone, methacrylic acid, methacryloylethylbetaine, etc. The preferred polysulfonate polymers are those based upon a polystyrene backbone. Preferred polymers for substantivity are those having higher molecular weights. For example, polyacrylic acid having molecular weights below about 10,000 are not particularly substantive and therefore do not normally provide hydrophilicity for three rewettings with all compositions, although with higher levels and/or certain surfactants like amphoteric and/or zwitterionic detergent surfactants, molecular weights down to about 1000 can provide some results. In general, the polymers should have molecular weights of more than 10,000, preferably more than about 20,000, more preferably more than about 300,000, and even more preferably more than about 400,000. It has also been found that higher molecular weight polymers, e.g., those having molecular weights of more than about 3,000,000, are extremely difficult to formulate and are less effective in providing anti-spotting benefits than lower molecular weight polymers. Accordingly, the molecular weight should normally be, especially for polyacrylates, from about 20,000 to about 3,000,000; preferably from about 20,000 to about 2,500,000; more preferably from about 300,000 to about 2,000,000; and even more preferably from about 400,000 to about 1,500,000.

An advantage for some polycarboxylate polymers is the detergent builder effectiveness of such polymers. Surprisingly, such polymers do not hurt filming/streaking and like other detergent builders, they provide increased cleaning effectiveness on typical, common "hard-to-remove" soils that contain particulate matter.

Some polymers, especially polycarboxylate polymers, thicken the compositions that are aqueous liquids. This can be desirable. However, when the compositions are placed in containers with trigger spray devices, the compositions are desirably not so thick as to require excessive trigger pressure. Typically, the viscosity under shear should be less than about 200 cp, preferably less than about 100 cp, more preferably less than about 50 cp, measured by a Brookfield viscometer at 20° C. using spindle #2 and 60 rpm. It can be desirable, however, to have thick compositions to inhibit the flow of the composition off the surface, especially vertical surfaces.

Examples of suitable materials for use herein include poly(vinyl pyrrolidone/acrylic acid) sold under the name "Acrylidone"® by ISP, polystyrene sulfonic acid and polystyrene sulfonate salts sold under the name "Versaflex"® by National Starch, and poly(acrylic acid) sold under the name "Accumer"® by Rohm & Haas. Most preferred are polymers formed by the polymerization or co-polymerization of vinyl pyrrolidone (VP) and acrylic acid (AA), or salts thereof Upon neutralization with a suitable base, the polymers have the structure

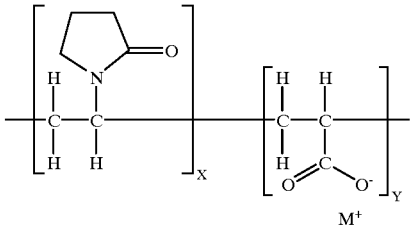

wherein M+ is an ammonium, alkanolammonium, or alkali metal salt, and wherein X and Y represent various degrees of polymerization of monomeric units in the polymer ranging from 1 to 100,000. While not wishing to be limited by theory, it is believed that the vinyl pyrrolidone moieties of the polymer protonate at near neutral or acidic pH and thereby become more glass substantive (glass is negatively charged). With the polymer anchored on the glass, it is believed that the acrylate functionalities of the polymer serve to hydrophilically modify the surface; thereby lowering the contact angle of rain droplets on the glass and promoting "sheeting action". Experimentally, increased rain sheeting translates into fewer spots following the rain event. Thus, the preferred polymers mitigate spotting from rain events.

The preferred salts of poly(vinyl pyrrolidone/acrylic acid) polymers [P(VP/AA)] are unlike conventional polycarboxylates in that high molecular weights are not needed for increased substantivity. Lower molecular weight polymers can be used and can be advantageous from a filming streaking perspective. In general, polymer molecular is preferably from about 5,000 to about 5,000,000, more preferably from about 10,000 to about 1,000,000, more preferably from about 20,000 to about 500,000, most preferably from about 50,000 to about 300,000. The ratio of VP to AA monomer in said polymers is from preferably about from 1:10 to about 10:1, more preferably from about 1:5 to about 5:1, and most preferably from about 1:3 to about 3:1. The distribution of monomeric units in the polymer can either be random or in the form of block-copolymers.

The level of substantive material should normally be from 0% to about 1.0%, preferably from about 0.01% to about 0.5%, more preferably from about 0.02% to about 0.2%, by weight of the composition. In general, lower molecular weight materials such as lower molecular weight poly (acrylic acid), e.g., those having molecular weights below about 10,000, and especially about 2,000, do not provide good anti-spotting benefits upon rewetting, especially at the lower levels, e.g., about 0.02%. One should use only the more effective materials at the lower levels. In order to use lower molecular weight materials, substantivity should be increased, e.g., by adding groups that provide improved attachment to the surface, such as cationic groups, or the materials should be used at higher levels, e.g., more than about 0.05%.

(E) Aqueous Solvent System and Optional Ingredients

The balance of the formula is typically water and non-aqueous polar solvents with only minimal cleaning action like methanol, ethanol, isopropanol, ethylene glycol, glycol ethers having a hydrogen bonding parameter of greater than 7.7, propylene glycol, and mixtures thereof, preferably ethanol. The level of non-aqueous polar solvent is usually greater when more concentrated formulas are prepared. Typically, the level of non-aqueous polar solvent is from about 0.5% to about 40%, preferably from about 1% to about 10%, more preferably from about 2% to about 8%

(especially for "dilute" compositions) and the level of water is from about 50% to about 99%, preferably from about 75% to about 95%.

The compositions herein can also contain other various adjuncts which are known to the art for detergent compositions. Preferably they are not used at levels that cause unacceptable filming/streaking. Non-limiting examples of such adjuncts are:

Enzymes such as proteases;

Hydrotropes such as sodium toluene sulfonate, sodium cumene sulfonate and potassium xylene sulfonate; and Aesthetic-enhancing ingredients such as colorants and perfumes, providing they do not adversely impact on filming/streaking in the cleaning of glass. Most hard surface cleaner products contain some perfume to provide an olfactory aesthetic benefit and to cover any "chemical" odor that the product may have. The main function of a small fraction of the highly volatile, low boiling (having low boiling points), perfume components in these perfumes is to improve the fragrance odor of the product itself, rather than impacting on the subsequent odor of the surface being cleaned. However, some of the less volatile, high boiling perfume ingredients can provide a fresh and clean impression to the surfaces, and it is sometimes desirable that these ingredients be deposited and present on the dry surface. The perfumes are preferably those that are more water-soluble and/or volatile to minimize streaking and filming. The perfumes useful herein are described in more detail in U.S. Pat. No. 5,108,660, Michael, issued Apr. 28, 1992, at col. 8 lines 48 to 68, and col. 9 lines 1 to 68, and col. 10 lines 1 to 24, said patent, and especially said specific portion, being incorporated by reference.

Antibacterial agents can be present, but preferably only at low levels to avoid filming/streaking problems. More hydrophobic antibacterial/germicidal agents, like orthobenzyl-para-chlorophenol, are avoided. If present, such materials should be kept at levels below about 0.1%.

Stabilizing ingredients can be present typically to stabilize more of the hydrophobic ingredients, e.g., perfume. The stabilizing ingredients include acetic acid and propionic acids, and their salts, e.g., $NH_4$, MEA, Na, K, etc., preferably acetic acid and the $C_2$–$C_6$ alkane diols, more preferably butane diol. The stabilizing ingredients do not function in accordance with any known principle. Nonetheless, the combination of amido zwitterionic detergent surfactant with linear acyl amphocarboxylate detergent surfactant, anionic detergent surfactant, nonionic detergent surfactant, or mixtures thereof, and stabilizing ingredient can create a microemulsion. The amount of stabilizing ingredient is typically from about 0.01% to about 0.5%, preferably from about 0.02% to about 0.2%. The ratio of hydrophobic material, e.g., perfume that can be stabilized in the product is related to the total surfactant and typically is in an amount that provides a ratio of surfactant to hydrophobic material of from about 1:2 to about 2:1.

Other detergent builders that are efficient for hard surface cleaners and have reduced filming/streaking characteristics at the critical levels can also be present in the compositions of the invention. Addition of specific detergent builders at critical levels to the present composition further improves cleaning without the problem of filming/streaking that usually occurs when detergent builders are added to hard surface cleaners. There is no need to make a compromise between improved cleaning and acceptable filming/streaking results, which is especially important for hard surface cleaners which are also directed at cleaning glass. These compositions containing these specific additional detergent builders have exceptionally good cleaning properties. They also have exceptionally good "shine properties, i.e., when used to clean glossy surfaces, without rinsing, they have much less tendency than, e.g., carbonate built products to leave a dull finish on the surface and filming/streaking.

Suitable additional optional detergent builders include salts of ethylenediaminetetraacetic acid (hereinafter EDTA), citric acid, nitrilotriacetic acid (hereinafter NTA), sodium carboxymethylsuccinic acid, sodium N-(2-hydroxypropyl)-iminodiacetic acid, and N-diethyleneglycol-N,N-diacetic acid (hereinafter DIDA). The salts are preferably compatible and include ammonium, sodium, potassium and/or alkanolammonium salts. The alkanolammonium salt is preferred as described hereinafter. A preferred detergent builder is NTA (e.g., sodium), a more preferred builder is citrate (e.g., sodium or monoethanolamine), and a most preferred builder is EDTA (e.g., sodium). Other preferred builders are tartrates, succinates, glutarates, adipates, and gluconates.

These additional optional detergent builders, when present, are typically at levels of from about 0.01% to about 0.5%. more preferably from about 0.02% to about 0.3%, most preferably from about 0.02% to about 0.15%. The levels of these additional builders present in the wash solution used for glass should be less than about 0.2%. Therefore, typically, dilution is highly preferred for cleaning glass, while fill strength is preferred for general purpose cleaning, depending on the concentration of the product.

All percentages, parts, and ratios herein are by weight unless otherwise specified. All references are incorporated herein, at least in pertinent part. The numerical limits herein, especially in the examples hereinafter, are approximations based upon normal variability.

The invention is illustrated by the following nonlimiting Examples.

Friction Meter Test

Procedure

Relative humidity (RH) is adjusted to 65%±5% prior to initiation of the test and a 2'×3' glass pane is first cleaned with distilled water, and tested for drag according to the procedure outlined below. A block (2"×2"×5") is taped with a single sheet of Bounty® paper towel so the outside surface of the towel covers the bottom of the block. The towel is taped and wrapped in such a way that no creases are present on the bottom area of the block (the area in contact with the glass plate).

Two sprays of product (1.0–1.1 ml each) are applied on a horizontally mounted glass surface. The product is wiped with Bounty® paper towel that has been folded in half three times. The towel is wiped lightly on the glass using eight side to side motions such that the entire glass surface is covered. This procedure is then repeated using an up and down wiping pattern, The towel is then flipped over to the dry side and the entire wiping procedure is repeated.

After the glass has dried for several minutes, the block is placed on the glass and is pushed along using an MF Shindo friction meter. The block is pushed along the glass at a rate of 15 cm/second±5 cm/second for two to three seconds, and the maximum force required to push the block is recorded. The block is then placed on another area of the glass pane that has been sprayed and another measurement is made. A total of three readings on each of the left, middle, and right vertical thirds of the glass are made and the relative humidity is recorded. Glass cleaned with distilled water has a coefficient of friction of approximately 1.0 to 1.1.

Grading

The force necessary to push the block across the surface is recorded. Generally, the more force necessary to push the block, the less glide the formula imparts to the glass Readings in the 0.3 to 0.5 range indicate that the product tested has a high degree of lubricity. Readings than a 1.0 correspond to a draggy surface, meaning that the product is not easy to wipe.

End Result Wipe Test

Procedure

Five sprays of the product to be tested are applied to a 2ft.×3ft. glass window (which can be soiled with body oils from a handprint) and wiped with two paper towels to near dryness, simulating actual consumer usage of the product.

Grading

Expert judges are employed to evaluate the specific areas of product application for amount of filming/streaking, with the aid of a floodlight to simulate a sunbeam. A numerical value describing the quality of the end result is assigned to each product. For the test results reported here a 0–6 scale is used, in which 0=good end result with no film/streak, and 6=very poor end result.

Sheeting/Spotting Test

Soil Preparation

A soil water mixture is made up using 0.02 grams of vacuum cleaner soil per 1 liter of distilled water. About 1 gram of vacuum cleaner soil is placed in the center of a Bounty® paper towel. The towel is then twisted with the ends together so as to form a pocket in which the soil is enclosed. This pocket of soil is lightly tapped against a beaker until the soil filters through the paper towel. In a large (2000 ml) beaker, 0.20 grams of the filtered vacuum soil is combined with 500 ml of distilled water and 500 ml of tap (7–8 gpg hardness) $H_2O$. The colloidal mixture is transferred to into a Cinch®/Mr. Proper® spray bottle just before use. This sprayer bottle will deliver 1.0–1.1 ml of product per spray.

Glass Preparation

Window glass made by the float process is cleaned by immersing glass panes (25 cm×25 cm) into a large bucket or other container filled with deionized H2O at a pH of 6.5±1. The glass is rinsed in hot water on both sides for at least 30 seconds. Both sides of the glass are then rinsed with cold DI water at both sides. The glass is further cleaned using steam by directing the steam against the glass from a distance of 25–30 cm for at least 30 seconds. The glass is then dried with Bounty® paper towels.

Sheeting/Spotting Test Procedure

A clean pane of glass is sprayed with test product (one spray) and wiped to near dryness using one paper Bounty® towel. The pressure applied to the paper towel is such that wet at the end of the operation but wetness quickly flashes off. The glass is allowed to dry at 30–40% RH for 12 hours. It is then moved to a high humidity environment (preferably 80% humidity) for one hour before initiating testing. The glass is sprayed with the soil/water mixture by spraying the top, middle and bottom portions of the glass pane using horizontal motions. This spraying pattern is repeated 3 times for a total of 9 sprays. A final 10th spray is applied across the top. The goal is to spray so as to cover the entire glass pane with the water/soil mixture.

Grading

Immediately after spraying, the plates are visually judged for sheeting action. A scale of 0=no sheeting and 6=total sheeting is used. Sheeting is the ability of the water solution to uniformly cover the glass surface. The plates are allowed to totally dry. To do this, the glass is transported to a low humidity environment (preferably 15–20% RH) and allowed to dry for at least 30 minutes. The glass panes are held up to 150 watt flood lamps and visually graded on the scale of 0=no spots and 6=Heavy spotting.

The procedure is repeated for the desired number of simulated rain cycles. With each new rain cycle application, sheeting deteriorates and the number and intensity of spots increases.

| INGREDIENT | 1 Wt. % | 2 Wt. % | 3 Wt. % | 4 Wt. % | 5 Wt. % | 6 Wt. % | 7 Wt. % | 8 Wt. % |
|---|---|---|---|---|---|---|---|---|
| Butoxypropanol | 2.0 | 2.0 | 2.0 | 2.0 | 2.0 | 2.0 | 2.0 | 2.0 |
| Ethanol | 3.0 | 3.0 | 3.0 | 3.0 | 3.0 | 3.0 | 3.0 | 3.0 |
| $C_{12-14}$ AS[1] | 0.24 | 0.24 | 0.24 | 0.24 | — | — | 0.24 | — |
| $C_{12-14}$ AS[2] | — | — | — | — | — | 0.24 | — | 0.24 |
| NaOH | to pH 10 | — | — | — | — | — | — | — |
| AMP | — | 0.025 | 0.05 | 0.075 | 0.075 | 0.025 | 0.025 | 0.025 |
| Citric acid | — | — | — | — | to pH 10 | — | — | — |
| PVP/AA (1:3)[3] | — | — | — | — | — | — | 0.04 | 0.04 |
| pH | 10.0 | 10.0 | 10.2 | 10.5 | 10.0 | 10.4 | 10.0 | 10.4 |

[1]Sodium $C_{12-14}$ sulfate with 55:45 $C_{12}$ to $C_{14}$ chain length carbon distribution available from Witco
[2]Sodium $C_{12-14}$ sulfate with 70:30 $C_{12}$ to $C_{14}$ chain length carbon distribution available from Stepan
[3]Sodium poly(vinyl pyrollidone/acrylate), VP/AA of about 1/3, and molecular weight of about 120,000 daltons.

The above formulas were tested according to the above method for friction using a friction meter (average of 3 replicates with standard deviation) and end result wipe (average of at least 7 replicates with standard deviation), with the results as follows:

| Formula | Friction Meter Coefficient (inches) | End Result Wipe Grade (0 = best, 6 = worst) |
|---|---|---|
| 1 | 0.43 ± 0.02 | 0.80 ± 0.22 |
| 2 | 0.43 ± 0.01 | 0.62 ± 0.25 |
| 3 | 0.56 ± 0.02 | 0.71 ± 0.30 |
| 4 | 0.68 ± 0.02 | 0.86 ± 0.24 |
| 5 | 0.72 ± 0.06 | 0.96 ± 0.44 |
| 6 | 0.50 ± 0.03 | 0.56 ± 0.14 |
| 7 | 0.38 ± 0.04 | 0.80 ± 0.25 |
| 8 | 0.40 ± 0.02 | 0.80 ± 0.35 |

Relative Humidity = 65%

As can be seen by the above example, the friction on the glass surface varies as a function of AMP levels, with the best results obtained in the 0.0 to 0.050% range. Lower coefficients of friction signify improved lubricity and therefore better product feel for the consumer. A reduction in the friction meter coefficient of about 0.1 is significant, and a reduction of about 0.2 is desirable, preferably more than about 0.25, and it is desirable that the coefficient be less than about 0.60, preferably less than about 0.55, and more preferably less than about 0.50. Best friction meter results are achieved using $C_{12-14}$ alkyl sulfate wherein $C_{14}$ chain length component constitutes 45% of the surfactant mixture, but very good results are also obtained with alkyl sulfate of lower $C_{14}$ content as illustrated by formula 6. Indeed, the $C_{14}$ chain length content can be eliminated entirely. Formula 9 was prepared in identical fashion to formulae 2 and 6, with $C_{12}$ alkyl sulfate replacing the $C_{12-14}$ alkyl sulfate surfactants at an equivalent weight percent (i.e., 0.24% $C_{12}$ alkyl sulfate). Friction meter measurements revealed a value of 0.53±0.02 at 63% RH. Note that the findings are not due to pH effects. Thus, formula 5 which contains high levels of 2-amino-2-methyl-1-propanol buffered at a high of 10, does not have the desired lubricity characteristics of formulae 2 and 3. Also note that formula 1 while possessing desirable lubricity and filming/streaking characteristics, is not appropriately buffered. For relatively low and constant surfactant levels (about 0.05 to 0.35%) which are consistent with good end result, the $C_{12}$–$C_{14}$ or longer chain lengths provide the most smoothness (lowest static friction height). However, as noted above, the compositions of the present invention can provide excellent lubricity properties to surfaces even in the absence of the $C_{14}$ chain length material. Qualitative evaluation shows that Formulae 1–3 provide noticeably improved surface lubricity during the wiping process as compared to Formulae 4–5.

Rain Spot Sheeting/Spotting Tests

Formulae 2 and 6 (which contain no polymer) were tested and compared to prototypes 7 and 8 respectively. The latter formulations additionally comprise 0.04% VP/AA co-polymer with a molecular weight of about 120,000 daltons. Sheeting and spotting properties were determined by expert graders on a 0–6 scale where a grade of "0" indicates a lack of sheeting or spotting and a grade of "6" suggests complete sheeting of water on the glass panes or complete spotting. Best results are achieved when the sheeting grades are high, i.e., rain sheets on the glass, and when the corresponding spotting grades are low, i.e., few spots are left on the glass after the simulated rain event.

| | Rain Cycle #1 | | Rain Cycle #2 | | Rain Cycle #3 | |
|---|---|---|---|---|---|---|
| Formula # | Sheeting | Spotting | Sheeting | Spotting | Sheeting | Spotting |
| 2 | 6.0 | 0.3 | 1.4 | 0.7 | 0.5 | 1.5 |
| 7 | 6.0 | 0.1 | 4.9 | 0.4 | 2.4 | 0.6 |
| 6 | 6.0 | 0.3 | 1.3 | 0.5 | 0.6 | 1.3 |
| 8 | 6.0 | 0.3 | 4.5 | 0.3 | 2.2 | 0.7 |

The above results show that formulations 7 and 8 which contain polymer, show improved sheeting properties than the corresponding formulations, 2 and 6, which do not contain the VP/AA copolymer. The improved sheeting properties due to presence of VP/AA polymer in formulations 7 and 8, translate into less spots once the windows panes dry.

What is claimed is:

1. An aqueous, liquid glass cleaning detergent composition having excellent surface lubricity and filming/streaking characteristics, comprising:

(A) less than about 1%, by weight of the composition, of surfactant that provides lubricity to the surface;

(B) from about 0.5% to about 30%, by weight of the composition, of a hydrophobic solvent having a hydrogen bonding parameter of from about 2 to 7.7;

(C) a low critical amount of alkaline buffering agent to provide buffering capacity equivalent to from about 0.010% to about 0.050% of 2-amino2-methyl-1-propanol;

(D) optionally, substantive material that increases the hydrophilicity of the glass; and (E) the balance being an aqueous solvent system selected from the group consisting of water and non-aqueous polar solvents having a hydrogen bonding parameter of greater than 7.7; and wherein said composition is essentially free of unreacted fatty alcohols that cause spotting/filming.

2. The composition of claim 1 wherein said surfactant is a linear alkyl sulfate detergent surfactant having the general formula:

$$R—O—SO_3M$$

wherein M is a suitable counter ion; R is an alkyl group having a chain length of from about $C_8$ to about $C_{18}$; wherein more than about 30% of said surfactant, by weight, has either a $C_{12}$ or a $C_{14}$ chain length or mixtures thereof and is present at a level of from about 0.01% to about 0.9%, by weight of the composition.

3. The composition of claim 2 wherein said surfactant is present at a level of from about 0.02 to about 0.35%, by weight of the composition.

4. The composition of claim 2 wherein R is an alkyl group having a chain length of from about $C_{12}$ to about $C_{18}$ and wherein more than about 50% of said alkyl sulfate surfactant contains either a $C_{12}$ or $C_{14}$ chain length or mixtures thereof.

5. The composition of claim 2 wherein R is an alkyl group having a chain length of from about $C_{12}$ to about $C_{18}$ and wherein more than about 40% of said alkyl sulfate surfactant has a $C_{14}$ chain length.

6. The composition of claim 2 wherein R is an alkyl group having a chain length of a $C_{12/14}$ blend having a $C_{12}$ to $C_{14}$ weight ratio of from about 1.5:10 to about 2:1.

7. The composition of claim 1 wherein said alkaline buffering agent is alkanolamine with a buffering capacity equivalent to from about 0.010% to about 0.050% of 2-amino-2-methyl-1-propanol to maintain the pH at from about 9.0 to about 10.5.

8. The composition of claim 7 wherein said alkaline buffering agent is beta-aminoalkanol with a buffering capacity equivalent to from about 0.015% to about 0.045% of 2-amino-2-methyl-1-propanol to maintain the pH at from about 9 to about 10.5.

9. The composition of claim 8 wherein said alkaline buffering agent is 2-amino-2-methyl-1-propanol at a level of from about 0.020% to about 0.040%, to maintain the pH at from about 9.0 to about 10.5.

10. The composition of claim 1 further comprising from an effective amount to increase alkalinity to about 0.5%, by weight of the composition of solubilized, water-soluble alkali metal carbonate salt, bicarbonate salt, or mixtures thereof.

11. The composition of claim 10 wherein said salt is selected from the group consisting of sodium carbonate, potassium carbonate, sodium bicarbonate, potassium bicarbonate, their respective hydrates, and mixtures thereof.

12. The composition of claim 1 further comprising from an effective amount to increase water sheeting to about 1.0% of a substantive material that increases hydrophilicity of glass.

13. The composition of claim 12 wherein said substantive material is polycarboxylate polymer.

14. The composition of claim 13 wherein said polycarboxylate polymer has a molecular weight of from about 5,000 to about 5,000,000.

15. The composition of claim 14 wherein said polycarboxylate polymer has a molecular weight of from about 20,000 and about 500,000.

16. The composition of claim 15 wherein said polycarboxylate polymer has a molecular weight of from about 50,000 to about 300,000.

17. The composition of claim 12 wherein said substantive material is a vinyl pyrrolidone/acrylate copolymer of structure

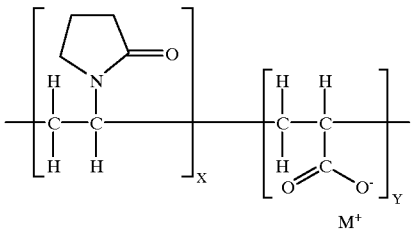

wherein M+ is an ammonium, alkanolammonium, or alkali metal salt, and where X and Y denote various degrees of polymerization of the two monomers, ranging from 1 to 100,000 and has a molecular weight of from about 5,000 to about 5,000,000.

18. The composition according to claim 17 wherein the ratio of vinyl pyrollidone to acrylate monomer in the polymer is from about 1:10 to about 10:1.

19. The composition according to claim 18 wherein the ratio of vinyl pyrollidone to acrylate monomer in the polymer is from about 1:3 to about 3:1.

20. The composition of claim 2 further comprising from an effective amount to increase water sheeting to about 1.0% of a substantive material that increases hydrophilicity of glass.

21. The composition of claim 20 wherein said substantive material is polycarboxylate polymer.

22. The composition of claim 21 wherein said polycarboxylate polymer has a molecular weight of from about 5,000 to about 5,000,000.

23. The composition of claim 22 wherein said polycarboxylate polymer has a molecular weight of from about 20,000 to about 500,000.

24. The composition of claim 23 wherein said polycarboxylate polymer has a molecular weight of from about 50,000 to about 300,000.

25. The composition of claim 20 wherein said substantive material is a vinyl pyrrolidone/acrylate copolymer of structure

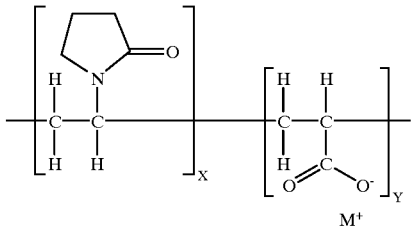

wherein M+ is an ammonium, alkanolammonium, or alkali metal salt, and where X and Y denote various degrees of polymerization of the two monomers, ranging from 1 to 100,000 and has a molecular weight of from about 5,000 to about 5,000,000.

26. The composition according to claim 23 wherein the ratio of vinyl pyrollidone to acrylate monomer in the polymer is from about 1:10 to about 10:1.

27. The composition according to claim 24 wherein the ratio of vinyl pyrollidone to acrylate monomer in the polymer is from about 1:3 to about 3:1.

28. The process of cleaning glass, comprising:

(A) spraying the composition of claim 1 onto a glass surface using a spraying device; and (B) wiping said surface to near dryness.

* * * * *